United States Patent [19]

Hawkins

[11] 4,069,160

[45] Jan. 17, 1978

[54] TEXTURING FINISH FOR SYNTHETIC FILAMENTS

[75] Inventor: Roland L. Hawkins, Spartanburg, S.C.

[73] Assignee: Hoechst Fibers Industries, Division of American Hoechst Corporation, Spartanburg, S.C.

[21] Appl. No.: 542,683

[22] Filed: Jan. 20, 1975

[51] Int. Cl.[2] ..... D06M 13/16; D06M 13/20; D06M 13/26

[52] U.S. Cl. ..... 252/8.9; 252/8.7; 252/8.8; 427/390 B

[58] Field of Search ..... 252/8.7, 8.8, 8.9, 51.5 R, 252/52 A; 427/390 B

[56] References Cited

U.S. PATENT DOCUMENTS

| | | | |
|---|---|---|---|
| 3,493,511 | 2/1970 | Law | 252/51.5 |
| 3,518,184 | 6/1970 | Potter | 252/8.75 |
| 3,563,892 | 2/1971 | Cooley | 252/8.9 X |
| 3,575,856 | 4/1971 | Anton | 252/8.9 |
| 3,634,117 | 1/1972 | Wegerhoff et al. | 252/8.9 X |
| 3,644,143 | 2/1972 | Flett | 252/8.9 X |
| 3,682,694 | 8/1972 | Kato et al. | 252/8.9 X |
| 3,719,597 | 3/1973 | Wegerhoff et al. | 252/8.8 |
| 3,855,776 | 12/1974 | Omura et al. | 252/8.9 X |
| 3,859,122 | 1/1975 | Burks et al. | 252/8.9 X |

FOREIGN PATENT DOCUMENTS

| | | |
|---|---|---|
| 1,040,082 | 8/1966 | United Kingdom. |
| 1,182,851 | 3/1970 | United Kingdom. |

OTHER PUBLICATIONS

Chem. Abs. 71:P82535f.
Chem. Abs. 74:P65477h.
Speel et al., Textile Chems. & Auxiliaries, 2 ed., pp. 115, 116, 367, 377, 378, (Reinhold 1957).

*Primary Examiner*—Thomas De Benedictis
*Attorney, Agent, or Firm*—Wellington M. Manning, Jr.; Luke J. Wilburn, Jr.

[57] ABSTRACT

An improved, low fuming, thermally stable, texturing finish for a synthetic filamentary material is disclosed comprising 40 to 75 percent of a lubricant, exemplified by pentaerythritol tetrapelargonate; 20 to 50 percent of an emulsifier, exemplified by condensates of castor oil with from about 2 to about 12 moles of ethylene oxide; 2 to 20 percent of an antistat-auxiliary emulsifier, such as a neutralized phosphate ester of an alcohol; and optionally 0 to 2 percent of a thermal stabilizer, exemplified by a condensate of 3-methyl-6-tert-butylphenol with crotonaldehyde. An oil in water emulsion is produced having an oil content of from about 5 to 20 weight percent.

16 Claims, No Drawings

TEXTURING FINISH FOR SYNTHETIC FILAMENTS

BACKGROUND OF THE INVENTION

Thermoplastic synthetic filamentary yarns are often designed for texturizing or other further processing to afford certain characteristics thereto. In a texturing operation, the filaments are subjected to heat, while being twisted by a false twist spindle, a friction disc or some other device, or while bent or distorted from linear form, to reorient the molecular structure of the filaments. A memory of a particular characteristic is retained, dependent upon the type processing steps utilized. Thereafter, additional heat is optional to further set or modify the reoriented structure. Stretch yarns and several kinds of set bulked yarns are produced commercially in this general fashion.

Under normal circumstances, the filamentary yarns are textured as bundles of filaments where the individual filaments unless properly pretreated, may abrade against adjacent filaments and/or portions of the processing equipment to the ultimate detriment of the yarn. Filaments having a particular finish thereon should thus preferably possess suitable frictional characteristics to avoid damage to the yarn while being texturized. Likewise, other very desirable finish characteristics are needed to achieve a good texturizing operation. Finish compositions have heretofore been developed toward this end.

Various and sundry finishes have heretofore been developed for application onto synthetic filaments at or subsequent to extrusion of the filaments. The particular finishes being applied have generally been accepted in their times as suitable for affording good lubrication and static qualities to the filament yarns to ensure proper processing during texturing, without allowing excessive damage to the yarn and/or causing excessive buildup of finish on the processing equipment. Prior art texturing finishes, also referred to as spin finishes, have been successful to a degree in protecting the filament yarn and affording stable operability.

As the art has progressed, however, equipment speeds and production rates have drastically increased due to larger demands for the yarn and, in part, due to the large capital investment required for additional equipment. Such increases in processing speeds have resulted in a need for higher yarn treatment temperatures at shorter exposure times. Other conditions have likewise changed such that in many cases, thermal and/or physical deterioration of the yarn finishes has resulted. Prior art finishes have generally volatilized to some considerable extent at the high processing temperatures. As the finish volatilizes, it is said to "fume", or produce a noticeable smoke, vapor or the like. Yarn characteristics afforded by the finish such as lubricity, antistatic qualities, and the like are, of course, altered by vaporization of an appreciable portion of the finish from the yarn.

Fumes from textile finishes cause multifaceted problems. The atmosphere is polluted by the fumes and must be purged, using expensive air handling systems. Condensation of the fumes on equipment and building surfaces creates housekeeping problems and quite possibly interferes with operation of the equipment. Contact between the yarn with the spin finish thereon and processing equipment causes some of the finish to rub off onto the equipment, which in time causes a finish buildup on the heated surfaces of equipment. Poor thermal stability of the finish on the equipment will cause the finish to degrade and leave a char residue on the equipment. A high fuming finish and one which pyrolyzes on the equipment to produce the char deposits leads to less than desirable yarn characteristics, e.g., broken filaments and processing conditions.

Attempts to overcome the above noted disadvantages have encountered further difficulty. Such attempts have generally not resulted in finishes that possess both a low degree of fuming and good thermal stability. At the same time, certain chemical compositions attack polyurethane aprons used on the texturing equipment causing the aprons to swell beyond the point of suitability for use. This feature must therefore be considered along with the low fuming and thermal stability characteristics. The present invention provides a textile finish that overcomes all the problems mentioned above. A low fuming propensity is realized along with good thermal stability against degradation. Good friction and static properties are imparted to the filaments which remain throughout processing. No significant effects have been noticed when the present finish is brought into contact with polyurethane machine components. All of these features point to significant improvement in the art.

The known prior art does not teach or suggest the present finish for synthetic filament yarn. Exemplary of the known prior art are U.S. Pat. Nos. 3,170,876 to Olney; 3,341,343 to Beiswanger et al; 3,341,451 to Dziuba et al; 3,470,095 to Pontelandolfo; 3,493,425 to Campbell; 3,503,880 to McMicken; 3,505,220 to Blake et al; 3,519,562 to Lanner; 3,522,175 to Katsumi et al; 3,541,138 to Emmons et al; 3,544,462 to Finch et al; 3,560,382 to Finch; 3,563,892 to Cooley; 3,644,143 to Flett; 3,652,419 to Karg; 3,681,244 to Obetz et al; 3,682,694 to Kato et al; 3,687,721 to Dardoufas; and 3,703,588 to Saito et al.

SUMMARY OF THE INVENTION

It is an object of the present invention to provide an improved textile finish for a thermoplastic filament yarn.

Another object of the present invention is to provide an improved finish for application onto a thermoplastic filament yarn to provide improved texturing capabilities thereto, while protecting the processing equipment.

Yet another object of the present invention is to provide an improved low fuming, thermally stable spin finish for a polyester filament yarn.

Still another object of the present invention is to provide an improved polyethylene terephthalate multifilament yarn having a thermally stable, low fuming finish thereon.

Generally speaking, the present invention relates to a spin finish composition comprising from about 40 to about 75 weight percent of a lubricant; from about 20 to about 50 weight percent of an emulsifier; from about 2 to about 20 weight percent of an antistat-emulsifier; and from about 0 to about 2 weight percent of a stabilizer, all of the ingredients of said composition having good thermal stability, a low fuming propensity and being capable of forming a stable emulsion.

More specifically, according to the present invention it is generally suitable to employ commonly known lubricants for finish compositions so long as the particular lubricant is compatible with other finish ingredients, and has good thermal stability and low volatility. Also, the lubricant, like the finish composition, should experience not more than a 25 weight percent loss when subjected to a temperature of 210° C. for a period of 24 hours. Exemplary of suitable lubricants are naturally occurring materials such as coconut oil, tall oil, sperm oil and the like and synthetic compounds such as glycerol trioleate and pentaerythritol esters of organic acids having from 4 to 14 carbon atoms such as pentaerythritol tetrapelargonate. The acid chain may also be provided by mixtures of acids in the prescribed range such as equal parts of decanoic and octanoic acids. Pentaerythritol tetrapelargonate is a preferred lubricant constituent for the finish of the present invention.

Primary emulsifiers suitable as ingredients for a finish composition according to the present invention include adducts of castor oil and/or hydrogenated castor oil and from about 2 to about 12 moles of ethylene oxide. This particular class of primary emulsifiers has been found very suitable in providing stable emulsions with the preferred pentaerythritol ester lubricants, e.g., pentaerythritol tetrapelargonate. The antistatauxiliary emulsifier is preferably a member selected from the group consisting of an adduct of an alcohol and ethylene oxide which has been phosphated and then neutralized with potassium hydroxide, such as a mixture of dodecyl and pentadecyl alcohol phosphates, containing certain amounts of ethylene oxide; and alkyl sulphates. Thermal stabilizers, while not mandatory may be employed in the recited range. Suitable stabilizers include, but are not limited to 4,4'-bis(dimethylbenzyl) diphenylamine and a 3:1 condensate of 3-methyl-6-tert-butylphenol with crotonaldehyde.

Finishes produced from compositions as defined according to the present invention are suitable for application onto textile materials to be textured or otherwise processed where good lubricity, low static, good thermal stability, and low fuming are required. Such filamentary materials include, but are not limited to filaments, yarns, tows and the like of synthetic polymeric, fiber-forming materials such as polyesters, polyamides, polyolefins, polyacrylonitriles and the like with the polyester filaments being preferred. The present finish may also be applied to staple fiber materials. By way of preparation of the finish composition, there is no particular order or process conditions that are required for bringing together the named constituents other than the normal procedures for the formation of stable emulsions. Moreover, the emulsions formed hereunder are oil in water emulsions in which from 5 to 20 weight percent oil phase is present.

DESCRIPTION OF THE PREFERRED EMBODIMENTS

Practice of the present invention involves the preparation of a finish composition for application onto synthetic polymeric, thermoplastic filamentary materials to render the materials suitable for further processing, particularly texturing operations. Generally, the finish composition of the present invention affords good lubrication and antistatic properties to the filaments without adversely affecting any of the other filament characteristics. Fuming, or volatilization of the finish is avoided while thermal stability against degradation avoids the char deposits that result from pyrolysis of finish on the processing equipment when using the prior art finishes. In other words, the instant finish if rubbed off the filaments onto the processing equipment remains thermally stable, whereby the deposits on the texturing equipment do not char. Normally, no appreciable deposits result on the equipment when the present finish is employed.

Filaments that may suitably receive the finish composition of the present invention, as mentioned above, include, but are not limited to polyesters, polyamides, polyolefins, polyacrylonitriles and the like. Moreover, the polymers may be copolymers, terpolymers or the like and may include blends of natural materials along with synthetic materials. Continuous filament textile yarns that may be monofilament or multifilament are, of course, the general recipients for the finish. Preferably the finish is applied to the filaments at the operation where the polymer is extruded into filament form.

A preferred filamentary material for receipt of the finish of the present invention is a continuous filament polyester yarn. Polyesters referred to are those fiber-forming polyesters which are generally derived by reacting a dicarboxylic acid or ester-forming derivative thereof with a glycol to form the bisglycol esters of the acid. Thereafter, the ester is condensed at elevated temperatures and reduced pressure to eliminate glycol and produce the polymer of the glycol ester of the dicarboxylic acid. Suitable glycols include, but are not limited to ethylene glycol, diethylene glycol, butylene glycol, decamethylene glycol, polyethylene glycol and the like including mixtures thereof. The dicarboxylic acid employed is generally terephthalic, though up to approximately 25 percent of the terephthalic acid may be replaced with one or more dicarboxylic acids or ester-forming derivatives thereof, exemplified by adipic acid, sebacic acid, isophthalic acid, dimethyl sebacate, sodium 3,5-dicarbomethoxybenzene sulfonate, and the like.

The aqueous emulsion according to the present invention as mentioned above, contains water, a lubricant, an emulsifier, an antistat-auxiliary emulsifier, and optionally, a stabilizer. In certain situations, it may further be desirable to include in the finish composition minor amounts of tints, defoamers, buffering agents, emulsifier assistants, and the like. These extra ingredients are acceptable in minor amounts so long as the primary effects of the finish are not impaired.

Lubricants suitable for use in producing the present finish composition are limited only in being compatible with the other ingredients to form a stable emulsion; and as having a low fuming propensity, low swelling effect on polyurethane and being thermally stable against degradation. Generally speaking, suitable lubricants can be selected by subjecting same to fuming and deposit tests. Fuming is determined visually from a one gram sample that is heated in an aluminum pan on a hot plate at a surface temperature of 210° C. for 15 minutes. After four hours on the hot plate under the above conditions, each sample is further visually noted for color and deposit formation and is weighed to determine weight loss. Acceptable low fuming lubricants experience a weight loss in the area of not more than approximately 25 weight percent after 24 hours at 210° C. Simultaneously, there should be no evidence of appreciable char formation. Suitable lubricants include refined coconut oil, glycerol trioleate, as well as high molecular weight fatty acid esters in general. A preferred lubricant is a pentaerythritol ester and most preferably pentaerythritol tetrapelargonate which loses no more than about 10-11 percent weight after 24 hours at a temperature of 210° C.

Emulsifiers according to the present invention should possess a capability of emulsifying the particular lubricant being employed while also having a low fuming propensity and being thermally stable against degradation which produces char formations on heated surfaces of the processing equipment. A group of emulsifiers that have proved quite satisfactory for inclusion in the present finish composition are adducts of castor oil and/or hydrogenated castor oil and from 2 to 12 moles of ethylene oxide. Similarly, to the lubricants discussed above, a primary qualification of the emulsifier is the combination of affording a stable emulsion characterized by low fuming and thermal stability against degradation. Preferably, the emulsifier does not chemically attack any portion of the process equipment.

Prior art finishes have heretofore been prepared primarily from lubricants and emulsifiers and antistats and have incidentally included minor amounts of various ancillary ingredients. One of the keys to success of the subject invention is the inclusion of a certain antistat-auxiliary emulsifier. This particular antistat-emulsifier affords good static qualities to the yarn, adds to the emulsion stability of the finish and meets the further requisite characteristics of low volatility and thermal stability. Suitable antistat-auxiliary emulsifiers according to the present invention are selected from a group consisting of neutralized, phosphated adducts of alcohols and various amounts of ethylene oxide, and alkyl sulfate esters. Most preferably, the alcohol chain length has from 8 to 18 carbon atoms and from 4 to 10 moles of ethylene oxide. Further, the phosphated adducts are preferred over the sulfates.

In preparation of the aqueous emulsions of the present invention, no particular mixing or formulating procedures are involved other than the normal preparation of an oil in water emulsion with an oil phase content in the range of from about 5 to about 20 weight percent. Thereafter, the composition while being maintained as an emulsion is applied to the filamentary material at the point of extrusion or subsequent thereto to render the filamentary material more suitable for texturing or further processing.

In determining the suitability of overall finish compositions, careful consideration was given each individual ingredient, as well as the compositions produced therefrom. A battery of screening evaluations was made for each prospective ingredient to determine the potential acceptability of certain physical characteristics of same, namely, low fuming, thermal stability against degradation, inertness to polyurethane, and static, emulsion and lubrication qualities. Acceptability of the abovementioned qualities also generally precludes the emergence of other related detrimental effects to the yarn during processing. For example, loss of proper lubrication due to fuming may adversely affect the strength characteristics of the individual filaments, due to extreme processing thereof. Condensation of finish fumes on processing equipment can lead to off-standard operating conditions such as low or varied spindle speeds. Also accumulations of finish that are not thermally stable on the processing equipment will lead to deposits of char formation which leads to improper processing and/or frequent machine cleanings. Polyurethane belts, aprons, or the like may be attacked by certain finish compositions and become partially or wholly eroded away or become swollen to produce broken and frayed filament ends as well as other processing problems.

The following examples set forth the investigative procedures for the present invention as well as a comparative analysis for at least certain of the prior art finishes.

EXAMPLES 1–18

Preliminary fuming and thermal stability tests were conducted as described above, and repeated below for convenience. These tests served as screens for prospective ingredients for inclusion in the subject finish composition. A 1 gram sample of the prospective ingredient as listed in Table I was weighed into an aluminum pan. Several samples in aluminum pans were placed on a hot plate whose surface temperature was 210° C. After fifteen minutes each sample was visually rated for fuming. After each four hours, each sample was further visually rated for color and deposit formation, and each was then reweighed to determine the degree of weight loss while subjected to the hot plate temperature. Reported data for weight loss and visual appearance are after 24 hours.

TABLE I

FUMING AND DEPOSIT DATA FOR EMULSION INGREDIENTS

| | EXAMPLE | WEIGHT LOSS, % AFTER 24 HOURS | VISUAL APPEARANCE AFTER 24 HOURS |
|---|---|---|---|
| 1 | A fatty acid sarcosine | 10.2 | solid - light brown |
| 2 | Adduct of POE (36) and castor oil | 4.3 | viscous - brown |
| 3 | A modified silicone | 66.9 | viscous - light brown |
| 4 | n-octyl, n-decyl adipate | 77.9 | slightly viscous - light brown |
| 5 | Adduct of polypropylene glycol 2250 and 10% ethylene oxide | 99.7 | some char - light brown |
| 6 | Oleylimidazolene ethyl sulfate | 10.9 | black char |
| 7 | Tridecyl adipate | 65.2 | very viscous - light brown |
| 8 | Tridecyl sebacate | 46.3 | viscous - light brown |
| 9 | A trimethylol triester | 55.5 | viscous - light brown |
| 10 | Trimethylol propane tripelargonate | 46.3 | viscous - clear |
| 11 | Pentaerythritol tetrapelargonate | 11.7 | slightly viscous - clear |
| 12 | Refined coconut oil | 17.1 | slightly viscous - clear |
| 13 | Dipropylene glycol dipelargonate | 90.8 | very viscous - light brown |
| 14 | Diisooctyl azelate | 89.9 | very viscous - light brown |
| 15 | Di-(2-ethyl hexyl) azelate | 73.5 | viscous - light yellow |
| 16 | Glycerol trioleate | 10.3 | viscous - light brown |
| 17 | Adduct of POE (5) and a 12–15 carbon alcohol, phosphated and neutralized with KOH | 25.8 | viscous - light brown |
| 18 | Adduct of POE (5) and castor oil | 8.8 | viscous - light brown |

All samples tested and reported in Table I were initially liquid, and with the exception of Example 6 (the oleylimidazolene ethyl sulfate), which was dark, all the samples were initially clear and light in color. Visual ratings considered both viscosity and color which indicate effects, if any, due to degradation from exposure to heat. A sample that remained less viscous with less color was much more stable to heat than one which became very viscous and/or exhibited a brown color. The adduct of POE 36 and castor oil of Example 2, an adduct of castor oil and 36 moles of ethylene oxide, shows a weight loss of only 4.3 percent, thus indicating extremely low fuming. A viscous, brown appearance after heating for 24 hours, however, illustrates possible formation of some deposits, resulting from degradation of the product under heat, though not as severely as others tested. Conversely, Example 3 directed to a modified silicone indicated a 66.9 percent weight loss after heating. Greater than half of the sample volatilized, indicating high fuming. Reference can further be made to the remaining Examples which illustrate compounds having various degrees of fuming, and thermal stability. Pentaerythritol tetrapelargonate of Example 11, a preferred lubricant hereunder evidenced an 11.7 percent weight loss and was observed after the 24 hours heating to be only slightly viscous, while remaining clear, indicating both low fuming and good thermal stability.

Having ascertained the predictability of fuming and deposit characteristics of certain individual ingredients, compositions containing same were then investigated and compared to present commercial finishes. Procedures and results are reported in Examples 19 through 26 below.

EXAMPLES 19–21

Finish compositions were prepared with the ingredients and percentages listed below. In each Example, the emulsions were prepared utilizing approximately 87 percent water to provide an oil phase of approximately 13 percent. Each of the compositions was evaluated in the same fashion as the individual ingredients of Examples 1 through 18. Additionally, each composition was tested for swelling effects on polyurethane as follows.

Polyurethane apron sections 4 to 5 centimeters in length were weighed and then the volume of same was measured. The sections were then submerged in the test composition for seven days at a temperature of 70° C. ± 1° C. After removal from the test composition, the apron samples were rinsed briefly in acetone to remove surface oil and then dried between two paper towels. The dimensions of the samples were rechecked and percentage volume changes noted.

Data are presented in Table II.

TABLE II

| Ex. NO. | COMPOSITION | WEIGHT LOSS, % | VISUAL APPEARANCE AFTER 24 HOURS AT 210° C. | POLYURETHANE VOLUME INCREASE. % |
|---|---|---|---|---|
| 19 | 60 parts pentaerythritol tetrapelargonate<br>30 parts adduct of POE (5) and castor oil<br>10 parts adduct of POE (5) and a 12–15 carbon alcohol, phosphated and neutralized with KOH | 14.2 | viscous - light brown | 8.2 |
| 20 | 60 parts refined coconut oil<br>30 parts adduct of POE (5) and castor oil<br>10 parts adduct of POE (5) and a 12–15 carbon alcohol, phosphated and neutralized with KOH | 11.7 | viscous - light brown | 9.6 |
| 21 | 60 parts glycerol trioleate<br>30 parts adduct of POE (5) and castor oil<br>10 parts adduct of POE (5) and a 12–15 carbon alcohol, phosphated and neutralized with KOH | 7.4 | viscous - light brown | 5.9 |

The compositions tested in Examples 19 through 21 demonstrate the effectiveness of compositions produced from ingredients from Table I that fall within the definition of the present invention. Note that all three of these compositions evidenced low weight loss indicating a low fuming characteristic; showed little swelling effect on polyurethane as exemplified by a volume change of less than 12 percent; and exhibited good thermal stability as shown by an absence of char deposit formation. Comparative prior art finishes were investigated and are reported hereinafter.

EXAMPLES 22–26

Prior art finish compositions were tested and compared to finish compositions of the present invention. Compositions evaluated included the following ingredients in emulsion form.

EXAMPLE 22:

44.5 parts isocetyl stearate
22.0 parts sodium di(2-ethylhexyl) sulfosuccinate
22.0 parts adduct three moles of ethylene oxide and stearyl alcohol
11.1 parts microcrystaline wax

EXAMPLE 23:

65.0 parts coconut oil
15.0 parts glycerol trioleate (sodium salt)
10.0 parts condensate of 6 moles of ethylene oxide with nonyl phenol
10.0 parts mixture of monoglycerol oleate and diglycerol oleate
1.0 parts oleic acid

EXAMPLE 24:

20.5 parts sulfated peanut oil
1.8 parts diethylene glycol
1.8 parts potassium hydroxide
62.6 parts butyl stearate
8.2 parts oleic acid
3.4 parts triethanolamine
1.7 parts o-phenylphenol

EXAMPLE 25:

1 part sodium di(2-ethylhexyl) sulfosuccinate
1 part adduct three moles of ethylene oxide and stearyl alcohol
2 parts butyl stearate

EXAMPLE 26:

2 parts isocetyl stearate
1 part sodium di(2-ethylhexyl) sulfosuccinate
1 part adduct five moles of ethylene oxide and nonyl phenol Each of the above compositions was tested similarly to the composition of Examples 19 through 21, using the same test procedures. Results are tabulated in Table III, where the results of compositions according to the present invention (Examples 19 through 21) are reproduced for comparison purposes.

TABLE III

EVALUATION OF PRIOR ART FINISH COMPOSITIONS

| EX. | WEIGHT LOSS, % AFTER 24 HOURS | VISUAL APPEARANCE AFTER 24 HOURS | POLYURETHANE VOLUME INCREASE, % |
|---|---|---|---|
| 19 | 14.2 | viscous - light brown | 8.2 |
| 20 | 11.7 | viscous - light brown | 9.6 |
| 21 | 7.4 | viscous - light brown | 5.9 |
| 22 | 76.7 | black char | 3.0 |
| 23 | 37.3 | black char | 6.5 |
| 24 | 83.5 | black char | 5.0 |
| 25 | 82.7 | black char | 4.3 |
| 26 | 75.9 | black char | 9.8 |

From Table III, it can be seen that while the prior art finishes did not appreciably attack the polyurethane apron as evidenced by a volume change of less than 12 percent, the extremely high weight loss indicated a high degree of fuming. Moreover, the black char indicates a degradation of the finish, and therefore poor thermal stability.

EXAMPLES 27–30

Further finish compositions according to the present invention were investigated according to the fuming, thermal stability, and polyurethane swelling tests as previously described. The compositions are listed below and results are tabulated in Table IV.

EXAMPLE 27:

60 parts pentaerythritol tetrapelargonate
30 parts adduct of five moles of ethylene oxide and hydrogenated castor oil
10 parts sodium alkyl sulfate

EXAMPLE 28:

60 parts pentaerythritol tetrapelargonate
30 parts adduct of five moles of ethylene oxide and hydrogenated castor oil
10 parts sodium 2-ethylhexyl sulfate

EXAMPLE 29:

60 parts pentaerythritol tetrapelargonate
30 parts adduct of five moles of ethylene oxide and hydrogenated castor oil
10 parts ammonium lauryl sulfate

EXAMPLE 30:

60 parts pentaerythritol tetrapelargonate
30 parts adduct of eight moles of ethylene oxide and hydrogenated castor oil
10 parts adduct of five moles of ethylene oxide and a mixture of $C_{12}$-$C_{16}$ alcohols, phosphated and neutralized with potassium hydroxide
1 part condensate adduct of three moles of 3-methyl-6-tert-butylphenol with crotonaldehyde

TABLE IV

COMPOSITIONS WITH ANTISTAT-EMULSIFIER AND/OR THERMAL STABILIZER

| EX. | WEIGHT LOSS, % | VISUAL APPEARANCE AFTER 24 HOURS | POLYURETHANE VOLUME INCREASE, % |
|---|---|---|---|
| 27 | 14.3 | slight viscous - little char | 5.2 |
| 28 | 14.8 | slight viscous - little char | 8.7 |
| 29 | 12.7 | slight viscous - little char | 2.7 |

TABLE IV-continued

COMPOSITIONS WITH ANTISTAT-EMULSIFIER AND/OR THERMAL STABILIZER

| EX. | WEIGHT LOSS, % | VISUAL APPEARANCE AFTER 24 HOURS | POLYURETHANE VOLUME INCREASE, % |
|---|---|---|---|
| 30 | 15.0 | slight viscous - little char | 8.2 |

The data in Table IV thus shows that the sulfate type antistat-auxiliary emulsifier are suitable according to the present invention. Likewise, the thermal stabilizer is effective.

EXAMPLE 31

The formulation of Example 30 was used in a trial for texturing 300,000 pounds of 150 denier, 32 filament polyester yarn on Scragg false twist texturing machines except that the emulsifier was a POE(5) adduct of hydrogenated castor oil instead of POE(8). Finish was applied to the yarn at an add-on of 0.55 weight percent. The trial lasted for a period of eight weeks. Similar yarn trials were also conducted for five week periods on ARCT and Leesona false twist texturing equipment. The textured yarn produced was within acceptable quality limits. No appreciable finish fuming was noted during the trials. Further, investigation of the equipment during and after the trials showed no appreciable finish deposits on the heater plates, no noticeable swelling of the polyurethane aprons or cots, and no slow spindles.

EXAMPLE 32

A further composition was evaluated on a one thousand pound lot of 150 denier, 32 filament polyester yarn on an ARCT false twist machine. The present composition differed from that of Example 31 only in that the lubricant, 60 percent pentaerythritol tetrapelargonate, was replaced with 60 percent of a pentaerythritol ester of a 50:50 mixture of decanoic and octanoic acids. Again, good processing results were found as in Example 31.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A finish composition for synthetic textile filaments comprising:

a. about 40 to about 75 weight percent of a high molecular weight fatty acid ester lubricant characterized by a weight loss of not more than 25 weight percent when subjected to a temperature of 210° C. for 24 hours;

b. about 20 to about 50 weight percent of an emulsifier for said lubricant, said emulsifier having a low fuming propensity and being stable against thermal degradation;

c. about 2 to about 20 weight percent of a neutralized phosphated adduct of an alcohol containing from about 8 to about 18 carbon atoms and about 4 to about 10 moles of ethylene oxide; and d. 0 to about 2 weight percent of a thermal stabilizer.

2. The finish composition as defined in claim 1 wherein the lubricant is an ester of a long chain polyhydric alcohol.

3. The finish as defined in claim 1 wherein the lubricant is a member selected from the group consisting of glycerol trioleate, refined coconut oil and pentaerythritol tetrapelargonate.

4. The finish as defined in claim 1 wherein said emulsifier is an adduct of a castor oil and from about 2 to about 12 moles of ethylene oxide.

5. The finish as defined in claim 4 wherein the castor oil is hydrogenated.

6. The finish as defined in claim 1 wherein the stabilizer is a condensate of three moles of 3-methyl-6-tert-butyl-phenol with one mole of crotonaldehyde.

7. The finish as defined in claim 1 wherein the lubricant is pentaerythritol tetrapelargonate which is present in an amount of about 60 weight percent and the emulsifier is an adduct of hydrogenated castor oil and about 5 moles of ethylene oxide and is present in an amount of about 30 weight percent.

8. A finish composition for synthetic textile filaments comprising:

a. about 40 to about 75 weight percent of a lubricant selected from the group consisting of glycerol trioleate, refined coconut oil and pentaerythritol tetrapelargonate;
b. about 20 to about 50 weight percent of an emulsifier selected from the group consisting of adducts of castor oil and hydrogenated castor oils and about 2 to 12 moles of ethylene oxide;
c. about 2 to about 20 weight percent of a neutralized phosphated adduct of an alcohol containing from about 8 to about 18 carbon atoms and about 4 to about 10 moles of ethylene oxide; and
d. 0 to about 2 weight percent of a thermal stabilizer.

9. A finish composition for synthetic textile filaments comprising:

a. about 40 to about 75 weight percent of a lubricant comprising an ester of pentaerythritol and an organic acid selected from the group of acids containing from 4 to 14 carbon atoms, said ester being characterized by a weight loss of not more than 25 weight percent when subjected to a temperature of 210° C. for 24 hours;
b. about 20 to about 50 weight percent of an emulsifier for said lubricant selected from the group consisting of adducts of castor oil or hydrogenated castor oil and from about 2 to about 12 moles of ethylene oxide;
c. about 2 to about 20 weight percent of a neutralized phosphated adduct of an alcohol containing from about 8 to about 18 carbon atoms and about 4 to about 10 moles of ethylene oxide; and
d. 0 to about 2 weight percent of a thermal stabilizer.

10. A low fuming texturing finish for a polyester multifilament yarn comprising from about 40 to about 75 weight percent pentaerythritol tetrapelargonate; about 20 to about 50 weight percent of an adduct of a castor oil and from about 2 to about 12 moles of ethylene oxide; and from about 2 to about 20 weight percent of a neutralized phosphated adduct of an alcohol and 4 to 10 moles of ethylene oxide.

11. The finish as defined in claim 10 wherein the castor oil is hydrogenated.

12. The finish as defined in claim 11 wherein the hydrogenated castor oil is adducted with 5 moles of ethylene oxide.

13. The finish as defined in claim 12 wherein the phosphated ester is an adduct of an alcohol having a chain length of 12 to 15 carbon atoms, and 5 moles of ethylene oxide.

14. An emulsion comprising 5 to 20 percent of the finish defined in claim 10.

15. A textile finish composition comprising: 60 percent of pentaerythritol tetrapelargonate; 30 percent of an adduct of five moles of ethylene oxide and one mole of hydrogenated castor oil; 10 percent of an adduct of five moles of ethylene oxide and a mixture of $C_{12}$ and $C_{15}$ alcohols, phosphated and neutralized with potassium hydroxide; and 1 percent of a condensate of three moles of 3-methyl-6-tert-butylphenol with one mole of crotonaldehyde.

16. An emulsion of water and 5–20 weight percent of the composition as defined in claim 15.

* * * * *